United States Patent [19]

Harwood et al.

[11] 3,981,102

[45] Sept. 21, 1976

[54] WARP RESISTANT FIRE DOOR

[75] Inventors: Frank Stuart Harwood, Richmond Hill; Heinz Otto Dorst, Milton, both of Canada

[73] Assignee: Dover Corporation, New York, N.Y.

[22] Filed: July 22, 1974

[21] Appl. No.: 490,486

[52] U.S. Cl. ..... 49/501; 49/409; 52/232; 52/619

[51] Int. Cl.[2] ..... E06B 3/16; E06B 5/16

[58] Field of Search ..... 49/501, 409, 410, 411, 49/412, 370; 52/615, 618, 619, 232

[56] References Cited

UNITED STATES PATENTS

| | | | |
|---|---|---|---|
| 1,139,842 | 5/1915 | Brogden et al. | 52/615 |
| 1,152,011 | 8/1915 | Doren | 49/409 X |
| 1,604,099 | 10/1926 | Johnson | 49/409 |
| 1,610,282 | 12/1926 | Hansen | 49/410 |
| 1,680,538 | 8/1928 | Gross | 52/619 |
| 3,001,614 | 9/1961 | Shane | 52/619 |
| 3,105,272 | 10/1963 | Tucker, Jr. | 49/411 |
| 3,325,941 | 6/1967 | Prucha | 49/370 X |
| 3,566,564 | 3/1971 | Gaeth et al. | 52/615 X |

*Primary Examiner*—Philip C. Kannan
*Attorney, Agent, or Firm*—Brumbaugh, Graves, Donohue & Raymond

[57] ABSTRACT

A warp resistant fire door structure is disclosed, which includes a frame and a pair of front and back panels mounted thereon. The panels are secured permanently to the frame only at points adjacent their lateral edges. At other points, the panels are heat releasably bonded to the frame to be able to expand and contract relative to the frame in the presence of ambient temperature extremes.

6 Claims, 3 Drawing Figures

WARP RESISTANT FIRE DOOR

BACKGROUND OF THE INVENTION

The present invention relates to fire doors and in particular to a fire door construction for use in elevators which is capable of withstanding ambient temperature extremes without destruction or undue warping of the door frame.

Heretofore, doors of this type have been constructed of front and back sheet paneling separated by metal frame spacers. The paneling is typically welded to each of the frame spacers.

Doors constructed in this fashion have heretofore been expensive since a considerable amount of labor time is required to fill and sand the welding blemishes on the door faces. In addition, such a rigid, essentially unitary, construction has been found to transmit an unacceptable level of background noise to the interior of the elevator.

Furthermore, under conditions of extreme ambient temperature changes, the unitary door structures, including the door frames, have been found to buckle severely thereby increasing the danger to elevator passengers. Such doors are frequently found to be commercially unacceptable during legally mandated testing procedures. The result is that the cost of doors which reach the market is higher than would otherwise be the case.

SUMMARY OF THE INVENTION

These and other disadvantages are overcome by the present invention which provides a warp resistant fire door having a frame structure covered with heat releasable paneling. The paneling consists of front and rear panels which are welded to the door frame only along its lateral edges. The panels are bonded to the frame at other points by means of a contact adhesive adapted to release in the presence of temperature extremes, for example, at high temperatures. At least one of the panels may be provided with an expansion capability which enables the panel to expand and contract in the presence of temperature extremes without imparting undue stress either to the welded joints or to the frame structure of the door.

BRIEF DESCRIPTION OF THE DRAWINGS

For a further understanding of the present invention, reference may be had to the accompanying drawings, in which.

BRIEF DESCRIPTION OF THE PREFERRED EMBODIMENTS

Figure 1:
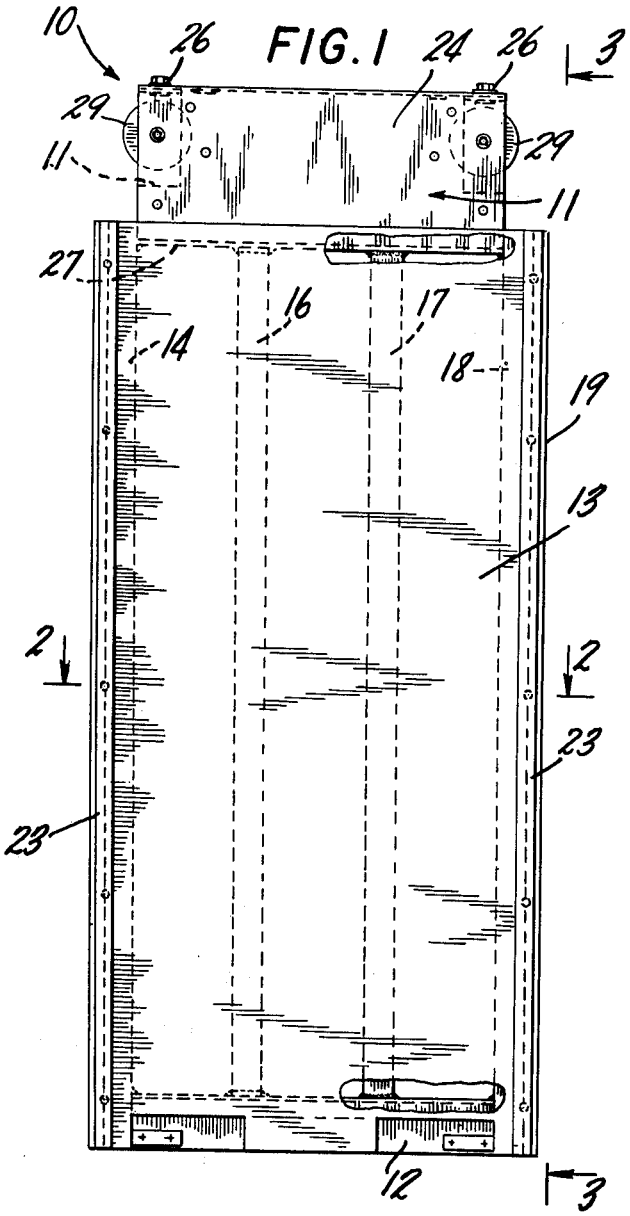
FIG. 1 is a plan view of a door constructed in accordance with the present invention.

Turning now to the drawings, and in particular to FIG. 1, there is illustrated a door structure, generally indicated by reference numeral 10, and consisting of a top header portion 11, a bottom header portion 12 and a central paneled area 13.

The paneled area 13 includes the central frame portion of the door which consists of a plurality of substantially vertical preferably tubular spacers or columns 14, 16, 17 and 18, indicated by broken lines in FIG. 1. The tubes 14–18 are joined preferably by welding, at their top and bottom ends to the top header portion and bottom header portion, respectively.

Figure 2:
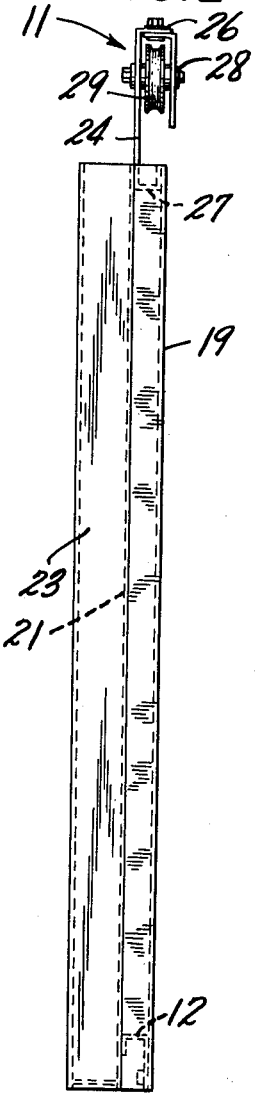
FIG. 2 is a view taken along the line 3—3 of FIG. 1.

With reference to FIG. 2, the paneling for the door consists of a pair of preferably sheet metal skins 19 and 21 which cover both the front and the back of the tubular frame structure. The skins extend from approximately the bottom of the top header 11 to the bottom of the bottom header 12 on each side of the frame.

In the preferred embodiment, each of the skins 19 and 21 is a substantially flat sheet having a substantially planar major surface area which defines the door panel area. The side or lateral edges of each of the skins 19 and 21 are bent in a substantially U-shaped configuration defining return bends 22 and 23, respectively.

The front or face sheet 19 is mounted over the plural frame structure of the door so that the inside surface of its major surface area lies flush against each of the tubular supports 14-18. The edges of the return bends 22 are adapted to abut against the two outside frame members 14 and 18. A plurality of plug welds or tack welds may be utilized permanently to join the edges of the return bends 22 to the frame. It has been found, for example, that approximately five such plug welds along the length of each of the tubes 14 and 18 is sufficient to secure the front face skin to the frame structure.

The rear face sheet 21 is connected to the door frame structure so that its major planar surface area lies flush against the tubular frame columns at points opposite the points of contact between the frame and the front face sheet 19. The return bends 23 extend inwardly over but are spaced from the exterior surface of the rear face sheet 21. The rear face sheet 21 may be tack or plug welded to the two outside frame columns 14 and 18 at the same locations as are the welds for the front face sheet 19.

In this way, the panels 19 and 21 and the outside frame columns 14 and 18 are welded together at the back of the door and only at points substantially adjacent the edges of the door.

In accordance with the invention, the skins 19 and 21 and the frame columns 14-18 are bonded together at the other points of contact, by means of an adhesive composition. The adhesive is preferably rubber based, and is such that it loses its adhering capability in the presence of a predetermined temperature in the skins. By way of example, an adhesive may be utilized which releases the bond when the skin temperature has been raised to aproximately 400 degrees, a temperature experienced typically by a door during the course of a fire. One example of a particularly suitable adhesive is a rubber based contact adhesive known by the tradename "Steinhall 471". The rubber based adhesive also serves to rigidify the structure and to dampen vibration in the door panelling.

It is important to note that at least one of the paneling skins 19 and 21 is welded to the frame structure of the door only along its lateral edges. In the preferred embodiment, it is the front facing sheet 19 which is secured to the frame in this manner. The clearance between the U-shaped ends of the skin 19 and the frame columns 14 and 18 permits the sheet 19 to expand and contract with respect to the fixed frame structure in the presence of extreme ambient temperature conditions. In this way, the expansion and contraction of the sheet 19 has only a minimal effect, if any, on either the tack welds at the end of the return bends 22 or the frame structure as a whole. The door frame is not severely stressed, for example, as a result of unequal bi-metallic expansion resulting from a temperature gradient across the door in the presence of a fire. Other paneling configurations which permit the front skin 19 to expand or contract relative to the frame structure in the presence of temperature extremes may be utilized without departing from the scope of the invention.

The rear skin 21 may be similarly adapted to expand and contract relative to the door frame if desired. However, such an arrangement may not be necessary, particularly, where the front skin 19 directly experiences the temperature extremes.

Figure 3:
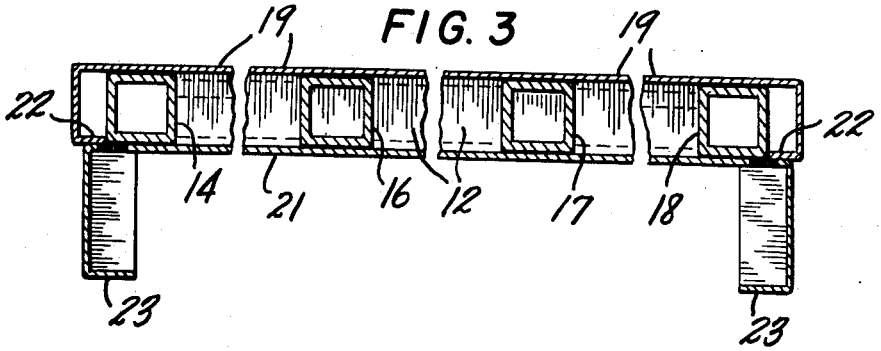
FIG. 3 is a view taken along the line 2—2 of FIG. 1.

With reference to FIG. 3, the top header portion of the door frame consists of a flat side wall portion 24 having an angled top 26 bent at substantially right angles to the side 24 and a turned-in substantially U-shaped bottom portion 27. The bottom portion 27 is welded to the tops of each of the tubular frame columns 14-18. An angle bracket 28 is fixed to the top 26 and extends downwardly substantially parallel to the side 24 to serve as one side of the mounting bracket for a plurality of hangar rollers 29. The rollers 29 are mounted on a suitable axis 31. The diameter of the rollers 29 is less than the vertical dimension of the angle bracket 28, so that the bracket 28 extends below the track (not shown) on which the door is hung. This arrangement prevents the door from coming off the track in the event that the rollers 29, usually made of nylon of the like, melt in the presence of a fire.

The door is assembled first by degreasing all of the parts and welding the rigid frame structure together with the top header 11 and bottom header 12. The areas of contact of the frame with the front and rear skins 19 and 21 are then sprayed with the contact adhesive. The sheets 19 and 21 are thereafter assembled onto the frame and the adhesive is permitted to cure. Alternatively, the interior surfaces of sheets 19 and 21 may be sprayed with the adhesive prior to assembly on the frame structure. The sheets are tack welded together and to the outside columns 14 and 18 of the frame.

It will be understood that the fire door according to the present invention is susceptible of various modifications, changes, and adaptations as will occur to those skilled in the art. For example, the front panel may be corrugated longitudinally to enable a predetermined amount of expansion and contraction relative to the frame structure. In this event, the return bends 22 may be eliminated. In addition, the panels may be permanently secured or welded to the frame at points other than at the ends of the frame. Preferably, at least the front covering or paneling is permanently secured to the frame at predetermined locations and is releasably bonded to the frame at other points. The bonded interface releases when ambient temperature extremes would otherwise induce expansive or contractive forces in the paneling tending to warp or buckle the door. The paneling is constructed so that upon release or dissolution of the bonded interface the paneling, which remains attached to the frame by the tack or plug welds, may expand or contract relative to the frame without severely stressing the frame. Other structural modifications may be made without departing from the scope of this invention, which is not deemed to be limited except as defined by the following claims.

What is claimed is:

1. A warp resistant fire door comprising a rigid frame structure defining at least one major side area and a pair of opposite minor side areas adjacent said major side area, a first outer skin portion susceptible of thermal expansion and contraction overlying the frame structure at each of the side areas and non-releasably secured to the frame structure at points other than those defining said major side area, portions of the skin between said points of securement and overlying said minor side areas being spaced apart from portions of the frame defining each of said minor side areas, and heat responsive means for attaching other portions of the skin to the frame structure to provide a rigid substantially vibration-free door panel in the presence of normal ambient temperatures, said heat responsive means releasing said other portions of the skin from the frame when the temperature of the skin reaches a predetermined level, thereby to minimize warping stresses induced on the frame by thermal expansion and contraction of the skin.

2. The door of claim 1 in which said frame structure defines a second major side area opposite the first major side area and the door comprises a second outer skin portion overlying and secured to the frame at said second major side area.

3. The door of claim 2 in which areas of both said first and second skins are joined to said frame structure by said heat responsive means.

4. The fire door of claim 1 in which a portion of the frame structure is uncovered and extends away from and substantially parallel to said first major side area and the door includes roller means connected to said uncovered portion for slidably supporting the door to enable the door to be moved between open and closed positions.

5. The door of claim 1 in which at least said first skin is welded to said frame structure at its side peripheral edges.

6. The door of claim 1 in which said heat responsive means comprises a rubber based contact adhesive.

* * * * *